US010202664B2

(12) United States Patent
Krizan et al.

(10) Patent No.: US 10,202,664 B2
(45) Date of Patent: Feb. 12, 2019

(54) HIGH STRENGTH COLD ROLLED STEEL SHEET

(71) Applicants: VOESTALPINE STAHL GMBH, Linz (AT); KOBE STEEL LTD, Hyogo (JP)

(72) Inventors: Daniel Krizan, Linz (AT); Stefan Paul, Trieben (AT); Andreas Pichler, Vocklabruck (AT); Michiharu Nakaya, Hyogo (JP)

(73) Assignees: VOESTALPINE STAHL GMBH, Linz (AT); KOBE STEEL, LTD, Chuo-Ku, Kobe Hyogo (JP)

( * ) Notice: Subject to any disclaimer, the term of this patent is extended or adjusted under 35 U.S.C. 154(b) by 683 days.

(21) Appl. No.: 14/380,945

(22) PCT Filed: Apr. 2, 2013

(86) PCT No.: PCT/EP2013/056957
§ 371 (c)(1),
(2) Date: Aug. 26, 2014

(87) PCT Pub. No.: WO2013/144377
PCT Pub. Date: Oct. 3, 2013

(65) Prior Publication Data

US 2015/0034218 A1 Feb. 5, 2015

(30) Foreign Application Priority Data

Mar. 30, 2012 (WO) ..... PCT/EP2012/055912

(51) Int. Cl.

| | |
|---|---|
| ***C22C 38/58*** | (2006.01) |
| ***C21D 8/02*** | (2006.01) |
| ***C21D 9/46*** | (2006.01) |
| ***C21D 1/20*** | (2006.01) |
| ***C22C 38/02*** | (2006.01) |
| ***C22C 38/04*** | (2006.01) |
| ***C22C 38/06*** | (2006.01) |
| ***C22C 38/00*** | (2006.01) |
| ***C22C 38/12*** | (2006.01) |
| ***C21D 1/26*** | (2006.01) |
| ***C21D 1/78*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C21D 8/0247* (2013.01); *C21D 1/20* (2013.01); *C21D 1/26* (2013.01); *C21D 1/78* (2013.01); *C21D 8/0226* (2013.01); *C21D 8/0236* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/22* (2013.01); *C22C 38/28* (2013.01); *C22C 38/32* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/58; C22C 38/54; C22C 38/50
See application file for complete search history.

(56) References Cited

U.S. PATENT DOCUMENTS

| | | | | |
|---|---|---|---|---|
| 2005/0133124 | A1* | 6/2005 | Kawano et al. | 148/546 |
| 2008/0251161 | A1 | 10/2008 | Kashima et al. | |

FOREIGN PATENT DOCUMENTS

| | | | |
|---|---|---|---|
| JP | 2003193193 | A | 7/2003 |
| JP | 2004332099 | | 11/2004 |
| JP | 2004332099 | A | 11/2004 |
| JP | 2009209450 | A | 9/2009 |
| JP | 2012031462 | A | 2/2012 |
| JP | 2012052199 | A | 3/2012 |
| WO | 2011118126 | | 9/2011 |
| WO | 2011148490 | | 12/2011 |

OTHER PUBLICATIONS

Machine translation of JP 2004332099, 2004.*
European Office Action; European Application Serial No. 13717208.6-1362; dated Sep. 26, 2016; 5 pages.
Japanese Office Action dated Oct. 18, 2016, for Japanese Patent Application No. 2015-502386.
China Patent Application Serial No. 201380016232.X; Second Office Action dated Jul. 14, 2016; 4 pages.
International Application No. PCT/EP2013/056957; Notification of Transmittal of the International Search Report and Written Opinion; dated Jul. 22, 2013; 9 pages.
Translation of Patent Abstract; Application No. 2004332099; Publication Date Nov. 25, 2004; 1 page.
First Office Action; Chinese Patent Application No. 201380016232.X; dated Nov. 25, 2015;10 Pages.

* cited by examiner

*Primary Examiner* — Edward Johnson
(74) *Attorney, Agent, or Firm* — Karceski IP Law, PLLC

(57) ABSTRACT

The present invention relates to high strength cold rolled steel sheet suitable for applications in automobiles, construction materials and the like, specifically high strength steel excellent in formability. In particular, the invention relates to cold rolled steel sheets having a tensile strength of at least 980 MPa and a method for producing such steel sheet.

19 Claims, No Drawings

HIGH STRENGTH COLD ROLLED STEEL SHEET

CROSS-REFERENCE TO RELATED APPLICATION(S)

This is a National Stage Entry into the United States Patent and Trademark Office from International PCT Patent Application No. PCT/EP2013/056957, having an international filing date of Apr. 2, 2013 and to Priority Patent Application No. PCT/EP2012/055912 having the priority date of Mar. 30, 2012, the contents of both of which are incorporated by reference herein in their entirety.

TECHNICAL FIELD

The present invention relates to high strength cold rolled steel sheet suitable for applications in automobiles, construction materials and the like, specifically high strength steel sheet excellent in formability. In particular, the invention relates to a cold rolled steel sheet having a tensile strength of at least 980 MPa.

BACKGROUND ART

For a great variety of applications increased strength levels are a pre-requisite for light weight constructions in particular in the automotive industry, since car body mass reduction results in reduced fuel consumption.

Automotive body parts are often stamped out of sheet steels, forming complex structural members of thin sheet. However, such part cannot be produced from conventional high strength steels because of a too low formability for complex structural parts. For this reason multi phase Transformation Induced Plasticity aided steels (TRIP steels) have gained considerable interest in the last years.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect, acts to resist necking in the material and postpone failure in sheet forming operations. The microstructure of a TRIP steel can greatly alter its mechanical properties. The most important aspects of the TRIP steel microstructure are the volume percentage, size and morphology of the retained austenite phase, as these properties directly affect the austenite to martensite transformation when the steel is deformed. There are several ways in which to chemically stabilize austenite at room temperature. In low alloy TRIP steels the austenite is stabilized through its carbon content and the small size of the austenite grains. The carbon content necessary to stabilize austenite is approximately 1 wt. %. However, high carbon content in steel cannot be used in many applications because of impaired weldability.

Specific processing routs are therefore required to concentrate the carbon into the austenite in order to stabilize it at room temperature. A common TRIP steel chemistry also contains small additions of other elements to help in stabilizing the austenite as well as to aid in the creation of microstructures which partition carbon into the austenite. The most common additions are 1.5 wt. % of both Si and Mn. In order to inhibit the austenite to decompose during the bainite transformation it is generally considered necessary that the silicon content should be at least 1 wt. %. The silicon content of the steel is important as silicon is insoluble in cementite. US 2009/0238713 discloses such a TRIP steel.

However, high silicon content can be responsible for a poor surface quality of hot rolled steel and a poor coatability of cold rolled steel. Accordingly, partial or complete replacement of silicon by other elements has been investigated and promising results have been reported for Al-based alloy design. However, a disadvantage with the use of aluminium is the rise of the transformation temperature ($A_{c3}$) which makes full austenitizing in conventional industrial annealing lines very difficult or impossible.

Depending on the matrix phase the following main types of TRIP steels are cited:

TPF TRIP Steel with Matrix of Polygonal Ferrite

TPF steels, as already mentioned before-hand, contain the matrix from relatively soft polygonal ferrite with inclusions from bainite and retained austenite. Retained austenite transforms to martensite upon deformation, resulting in a desirable TRIP effect, which allows the steel to achieve an excellent combination of strength and drawability. Their stretch flangeability is however lower compared to TBF, TMF and TAM steels with more homogeneous microstructure and stronger matrix.

TBF TRIP Steel with Matrix of Bainitic Ferrite

TBF steels have been known for long and attracted a lot of interest because the bainitic ferrite matrix allows an excellent stretch flangeability. Moreover, similarly to TPF steels, the TRIP effect, ensured by the strain-induced transformation of metastable retained austenite islands into martensite, remarkably improves their drawability.

TMF TRIP Steel with Matrix of Martensitic Ferrite

TMF steels also contain small islands of metastable retained austenite embedded into strong martensitic matrix, which enables these steels to achieve even better stretch flangeability compared to TBF steels. Although these steels also exhibit the TRIP effect, their drawability is lower compared to TBF steels.

TAM TRIP Steel with Matrix of Annealed Martensite

TAM steels contain the matrix from needle-like ferrite obtained by re-annealing of fresh martensite. A pronounced TRIP effect is again enabled by the transformation of metastable retained austenite inclusions into martensite upon straining. Despite their promising combination of strength, drawability and stretch flangeability, these steels have not gained a remarkable industrial interest due to their complicated and expensive double-heat cycle.

The formability of TRIP steels is mainly affected by the transformation characteristics of the retained austenite phase, which is in turn affected by the austenite chemistry, its morphology and other factors. In ISIJ International Vol. 50 (2010), No. 1, p. 162-168 aspects influencing on the formability of TBF steels having a tensile strength of at least 980 MPa are discussed. However, the cold rolled materials examined in this document were annealed at 950° C. and the austempered at 300-500° C. for 200 s in salt bath. Accordingly, due to the high annealing temperature these materials are not suited for the production in a conventional industrial annealing line.

DISCLOSURE OF THE INVENTION

The present invention is directed to a high strength cold rolled steel sheet having a tensile strength of at least 980

MPa and having an excellent formability and a method of producing the same on an industrial scale. In particular, the invention relates to a cold rolled TBF steel sheet having properties adapted for the production in a conventional industrial annealing-line. Accordingly, the steel shall not only possess good formability properties but at the same time be optimized with respect to $A_{c3}$-temperature, $M_s$-temperature, austempering time and temperature and other factors such as sticky scale influencing the surface quality of the hot rolled steel sheet and the processability of the steel sheet in the industrial annealing line.

DETAILED DESCRIPTION

The invention is described in the claims.

The cold rolled high strength TBF steel sheet has a steel composition consisting of the following elements (in wt. %):

| | |
|---|---|
| C | 0.1-0.3 |
| Mn | 2.0-3.0 |
| Si | 0.4-1.0 |
| Cr | ≤0.9 |
| Si + 0.8 Al + Cr | 0.5-1.8 |
| Al | 0.01-0.8 |
| Nb | <0.1 |
| Mo | <0.3 |
| Ti | <0.2 |
| V | <0.2 |
| Cu | <0.5 |
| Ni | <0.5 |
| S | ≤0.01 |
| P | ≤0.02 |
| N | ≤0.02 |
| B | <0.005 |
| Ca | <0.005 |
| Mg | <0.005 |
| REM | <0.005 |

balance Fe apart from impurities.

The limitation of the elements is explained below.

The limitation of the elements C, Mn, Si, Al and Cr is essential to the invention for the reasons set out below:

C: 0.1-0.3%

C is an element which stabilizes austenite and is important for obtaining sufficient carbon within the retained austenite phase. C is also important for obtaining the desired strength level. Generally, an increase of the tensile strength in the order of 100 MPa per 0.1% C can be expected. When C is lower than 0.1% then it is difficult to attain a tensile strength of 980 MPa. If C exceeds 0.3% then weldability is impaired. For this reasons, preferred ranges are 0.15-0.25%, 0.15-0.18%, 0.17-0.20% or 0.18-0.23% depending on the desired strength level.

Mn: 2.0-3.0%

Manganese is a solid solution strengthening element, which stabilises the austenite by lowering the $M_s$ temperature and prevents ferrite and pearlite to be formed during cooling. In addition, Mn lowers the $A_{c3}$ temperature. At a content of less than 2% it might be difficult to obtain a tensile strength of 980 MPa and the austenitizing temperature might be too high for conventional industrial annealing lines. However, if the amount of Mn is higher than 3% problems with segregation may occur and the workability may be deteriorated. Preferred ranges are therefore 2.2-2.6%, 2.2-2.4% and 2.3-2.7%.

Si: 0.4-1.0

Si acts as a solid solution strengthening element and is important for securing the strength of the thin steel sheet. Si is insoluble in cementite and will therefore act to greatly delay the formation of carbides during the bainite transformation as time must be given to Si to diffuse away from the bainite grain boundaries before cementite can form. Preferred ranges are therefore 0.6-1.0%, 0.7-0.9% and 0.75-0.90%.

Cr: ≤0.9

Cr is effective in increasing the strength of the steel sheet. Cr is an element that forms ferrite and retards the formation of pearlite and bainite. The $A_{c3}$ temperature and the $M_s$ temperature are only slightly lowered with increasing Cr content. However, due to the retardation of the bainite transformation longer holding times are required such that the processing on a conventional industrial annealing line is made difficult or impossible, when using normal line speeds. For this reason the amount of Cr is preferably limited to 0.6%. Preferred ranges are 0-0.4, 0.1-0.35

Si+0.8 Al+Cr=0.5-1.8

Si, Al and Cr when added in combination have a synergistic and completely unforeseen effect, resulting in an increased amount of residual austenite, which, in turn, results in an improved ductility. For these reasons the amount of Si+0.8 Al+Cr is preferably limited to the range 0.8-1.8%. Preferred ranges are therefore 1.0-1.8%, 1.2-1.8% and 1.4-1.8%.

Al: 0.01-0.8

Al promotes ferrite formation and is also commonly used as a deoxidizer. Al, like Si, is not soluble in the cementite and therefore diffuses away from the bainite grain boundaries before cementite can form. The $M_s$ temperature is increased with increasing Al content. A further drawback of Al is that it results in a drastic increase in the $A_{c3}$ temperature such that the austenitizing temperature might be too high for conventional industrial annealing lines. For these reasons the Al content is preferably limited to 0.2-0.8%, more preferably 0.40-0.75%. The contents of Al refers to acid soluble Al.

In addition to C, Mn, Si, Al and Cr the steel may optionally contain one or more of the following elements in order to adjust the microstructure, influence on transformation kinetics and/or to fine tune one or more of the mechanical properties of the steel sheet.

Nb: <0.1

Nb is commonly used in low alloyed steels for improving strength and toughness because of its remarkable influence on the grain size development. Nb increases the strength elongation balance by refining the matrix microstructure and the retained austenite phase due to precipitation of NbC. At contents above 0.1% the effect is saturated.

Preferred ranges are therefore 0.02-0.08%, 0.02-0.04% and 0.02-0.03%.

Mo: <0.3

Mo can be added in order to improve the strength of the steel sheet. Addition of Mo together with Nb results in precipitation of fine NbMoC which results in a further improvement in the combination of strength and ductility.

Ti: <0.2; V: <0.2

These elements are effective for precipitation hardening. Ti may be added in preferred amounts of 0.01-0.1%, 0.02-0.08% or 0.02-0.05%. V may be added in preferred amounts of 0.01-0.1% or 0.02-0.08%.

Cu: <0.5; Ni: <0.5

These elements are solid solution strengthening elements and may have a positive effect on the corrosion resistance. The may be added in amounts of 0.05-0.5% or 0.1-0.3% if needed.

S: ≤0.01; P: ≤0.02; N: ≤0.02

These elements are not desired in this type of steel and should therefore be limited.

S preferably ≤0.003

P preferably ≤0.01

N preferably ≤0.003

B: <0.005

B suppresses the formation of ferrite and improves the weldability of the steel sheet. For having a noticeable effect at least 0.0002% should be added. However, excessive amounts of deteriorate the workability. Preferred ranges are <0.004%, 0.0005-0.003% and 0.0008-0.0017%.

Ca: <0.005; Mg: <0.005; REM: <0.005

These elements may be added in order to control the morphology of the inclusions in the steel and thereby improve the hole expansibility and the stretch flangeability of the steel sheet. Preferred ranges are 0.0005-0.005% and 0.001-0.003%.

Si>Al

The high strength cold rolled steel sheet according to the invention has a silicon aluminium based design, i.e. the cementite precipitation during the bainitic transformation is accomplished by Si and Al. Although the amount of Si is reduced is preferably that it is larger than the amount of Al, preferably Si>1.1 Al, more preferably Si>1.3 Al or even Si>2 Al.

Si>Cr

In the steel sheet of the present invention it is preferred to control the amount of Si to be larger than the amount of Cr and to restrict the amount of Cr in order to retard the bainite transformation too much. For this reason it preferred to keep Si>Cr, preferably Si>1.5 Cr, more preferably Si>2 Cr, most preferably Si>3 Cr.

The cold rolled high strength TBF steel sheet has a multiphase microstructure comprising (in vol. %)

| | |
|---|---|
| retained austenite | 5-20 |
| bainite + bainitic ferrite + tempered martensite | ≥80 |
| polygonal ferrite | ≤10 |

The amount of retained austenite is 5-20%, preferably from 5-16%, most preferably from 5-10%. Because of the TRIP effect retained austenite is a prerequisite when high elongation is necessary. High amount of residual austenite decreases the stretch flangeability. In these steel sheet the polygonal ferrite is replace by bainitic ferrite (BF) and the microstructure generally contains more than 50% BF. The matrix consists of BF laths strengthened by a high dislocation density and between the laths the retained austenite is contained.

MA (martensite/austenite) constituent represents the individual islands in the microstructure consisting of retained austenite and/or martensite. These two microstructural compounds are difficult to be distinguished by common etching technique for advanced high strength steels (AHSS)—Le Pera etching and also by investigations with scanning electron microscopy (SEM). Le Pera etching, which is very common to the person skilled in the art can be found eg in "F. S. LePera, Improved etching technique for the determination of percent martensite in high-strength dual-phase steels Metallography, Volume 12, Issue 3, September 1979, Pages 263-268". Furthermore, for properties such as hole expansion the amount and size of MA constituent plays an important role. Therefore, in an industrial practice the fraction and size of MA constituent are often used by AHSS for the correlations in terms of their mechanical properties and formability.

The size of the martensite-austenite (MA) shall be max 5 μm, preferably 3 μm. Minor amounts of martensite may be present in the structure. The amount of MA shall be max 20%, preferably max 16%, most preferably below 10%.

The cold rolled high strength TBF steel sheet preferably has the following mechanical properties

| | |
|---|---|
| tensile strength ($R_m$) | ≥980 MPa |
| total elongation ($A_{80}$) | ≥10% |
| hole expanding ratio (λ) | ≥44%, preferably ≥50%. |

The $R_m$ and $A_{80}$ values were derived according to the European norm EN 10002 Part 1, wherein the samples were taken in the longitudinal direction of the strip.

The hole expanding ratio (80) was determined by the hole expanding test according to ISO/WD 16630. In this test a conical punch having an apex of 60° is forced into a 10 mm diameter punched hole made in a steel sheet having the size of 100×100 $mm^2$. The test is stopped as soon as the first crack is determined and the hole diameter is measured in two directions orthogonal to each other. The arithmetic mean value is used for the calculation.

The hole expanding ratio (λ) in % is calculated as follows:

$$\lambda=(Dh-Do)/Do\times 100$$

wherein Do is the diameter of the hole at the beginning (10 mm) and Dh is the diameter of the hole after the test.

The formability properties of the steel sheet were further assessed by the parameters: strength-elongation balance ($R_m \times A_{80}$) and stretch-flangeability ($R_m \times \lambda$).

An elongation type steel sheet has a high strength-elongation balance and a high hole expansibility type steel sheet has a high stretch flangeability.

The steel sheet of the present invention fulfils at least one of the following conditions:

| | |
|---|---|
| $R_m \times A_{80}$ | ≥13 000 MPa % |
| $R_m \times \lambda$ | ≥50 000 MPa % |

The mechanical properties of the steel sheet of the present invention can be largely adjusted by the alloying composition and the microstructure.

According to one conceivable variant of the invention the steel comprises 0.17-0.19 C, 2.3-2.5 Mn, 0.7-0.9 Si, 0.6-0.7 Al. Optionally Si+0.8 Al+Cr is regulated to 1.0-1.8 and further the steel may comprise 0.02-0.03 Nb. The steel sheet fulfils at least one of the following requirements: ($R_m$)=980-1200 MPa, ($A_{80}$)≥11%, (λ)≥45%, preferably ≥50%, and further at least one of: $R_m \times A_{80}$≥13 000 MPa %, preferably ≥14 000 MPa %, and $R_m \times \lambda$≥50 000 MPa %, preferably ≥55 000 MPa %.

A typical chemical composition may comprise 0.17 C, 2.3 Mn, 0.80 Si, 0.3-0.7 Al, rest Fe apart from impurities.

According to another conceivable variant of the invention the steel comprises 0.18-0.23 C, 2.3-2.7 Mn, 0.7-0.9 Si, 0.7-0.9 Cr. Optionally Si+0.8 Al+Cr is regulated to 1.3-1.8 and further the steel may comprise 0.02-0.03 Nb. The steel sheet fulfils at least one of the following requirements: ($R_m$)=1050-1400 MPa, ($A_{80}$)≥10%, preferably ≥12%, (λ)≥40%, preferably ≥44%, and further at least one of: $R_m \times A_{80}$≥13 000 MPa %, preferably ≥15 000 MPa %, and $R_m \times \lambda$≥50 000 MPa %, preferably ≥52 000 MPa %.

A typical chemical composition may comprise 0.19 C, 2.6 Mn, 0.82 Si, 0.3-0.7 Al, 0.10 Mo, rest Fe apart from impurities.

The steel sheets of the present invention can be produced using a conventional CA-line. The processing comprises the steps of:

a) providing a cold rolled steel strip having a composition as set out above, b) annealing the cold rolled steel strip at an annealing temperature, $T_{an}$, above the $A_{c3}$ temperature in order to fully austenitize the steel, followed by c) cooling the cold rolled steel strip from the annealing temperature, $T_{an}$, to a cooling stop temperature of rapid cooling, $T_{RC}$, at a cooling rate sufficient to avoid the ferrite formation, the cooling rate being 20-100° C./s, while:

for a high hole expansion type steel sheet the cooling stop temperature, $T_{RC}$, being lower than the martensite start temperature, $T_{MS}$, $T_{MS}$ being between 300 and 400° C., preferably between 340 and 370° C., for a high elongation type steel sheet the cooling stop temperature, $T_{RC}$, being between 360 and 460° C., preferably between 380 and 420° C., followed by d) austempering the cold rolled steel strip at an overageing/austempering temperature, $T_{OA}$, that is between 360 and 460° C., preferably between 380 and 420° C., and e) cooling the cold rolled steel strip to ambient temperature.

The process shall preferably further comprise the steps of:

in step b) the annealing being performed at an annealing temperature, $T_{an}$, that is between 910 and 930° C., during an annealing holding time, $t_{an}$, which is between 150-200 s, preferably 180 s, in step c) the cooling being performed according to a cooling pattern having two separate cooling rates; a first cooling rate, CR1, of 80-100° C./s, preferably of 85-95° C./s, preferably about 90° C./s to a temperature which is between 530 to 570° C., preferably 550° C., and a second cooling rate, CR2, of 35-45° C., preferably about 40° C./s to the stop temperature of rapid cooling, $T_{RC}$, and in step d) the austempering being performed at an overageing/austempering holding time, $t_{OA}$, which is between 150 and 600 s, preferably 180 and 540 s.

Preferably, no external heating is applied to the steel strip between step c) and d).

The reasons for regulating the heat treatment conditions are set out below:

Annealing temperature, $T_{an}$, $>A_{c3}$ temperature:

By fully austenitizing the steel the amount of polygonal ferrite in the steel sheet can be controlled. If the annealing temperature, $T_{an}$, is below the temperature at which the steel is fully austenitic, $A_{c3}$, there is a risk that the amount of polygonal ferrite in the steel sheet will exceed 10%. Too much polygonal ferrite gives larger size of the MA constituent.

Cooling Stop Temperature of Rapid Cooling, $T_{RC}$:

By controlling the cooling stop temperature of rapid cooling, $T_{RC}$, the size of MA constituent in the steel sheet can be controlled. If the cooling stop temperature of rapid cooling, $T_{RC}$, exceeds the martensite start temperature, $T_{MS}$, the size of MA constituent becomes larger which lowers the $R_m \times \lambda$ product under the value necessary for a high hole expansion type steel sheet. In the case of a high elongation type steel sheet the cooling stop temperature, $T_{RC}$ might be above the martensite start temperature, $T_{MS}$.

Austempering Temperature, $T_{OA}$:

By controlling the austempering temperature, $T_{OA}$, to a temperature between 360 and 460° C., preferably between 380 and 420° C., the size of MA constituent and the amount of retained austenite, RA, can be controlled. A lower austempering temperature, $T_{OA}$, will lower the amount of RA. A higher austempering temperature, $T_{OA}$, will lower the amount of RA and increase the size of MA constituent. In both cases, this will lower the uniform elongation, Ag, and total elongation, $A_{80}$, of the steel sheet.

First and Second Cooling Rates, CR1, CR2:

By controlling the first cooling rate, CR1, of 80-100° C./s, preferably of 85-95° C./s, preferably about 90° C./s to a temperature which is between 530 to 570° C., preferably 550° C., and a second cooling rate, CR2, of 35-45° C., preferably about 40° C./s to the stop temperature of rapid cooling, $T_{RC}$, the amount of polygonal ferrite can be controlled. Lowering the cooling rates will increase the amount of polygonal ferrite to more than 10%.

In one embodiment of the invention the steel sheet is a high elongation type steel having strength-elongation balance $R_m \times A_{80} \geq 13\ 000$ MPa %, preferably ≥15 000 MPa.

In another embodiment of the invention the steel sheet is a high hole expansibility type steel having stretch-flangeability $R_m \times \lambda \geq 50\ 000$ MPa %, preferably ≥55 000 MPa.

EXAMPLES

A number of test alloys A-M were manufactured having chemical compositions according to table I. Steel sheets were manufactured and subjected to heat treatment in a conventional CA-line according to the parameters specified in Table II. The microstructure of the steel sheets were examined along with a number of mechanical properties and the result is presented in Table II The positive influence of the claimed composition on the structure and the mechanical properties is evident when comparing the results of the inventive steel sheets with the results of the comparative steel sheets. Table II shows that in some cases the amount of residual austenite was too low (Nos. 16, 17, 21, 22) and that in other cases the amount of ferrite was too high (Nos. 14, 15, 18, 19, 20). In most cases the hole stretch flangabilty was too low.

A completely different behaviour is found for the inventive steel sheets. Partly based on these results the claimed TBF steel sheet having a Si—Al based alloy design, optionally with additions of Cr having a high stretch flangeability and an improved processability for the production in a continuous annealing line was developed.

Quantitative Measurement of Microstructures

Amount of retained austenite was measured by X ray analysis at a ¼ position of the sheet thickness. A photograph of a microstructure taken by the SEM was subjected to image analysis to measure each of a volume-% of a MA, volume-% of matrix phase (bainitic ferrite+bainite+tempered martensite), volume-% of retained austenite and volume-% of polygonal ferrite.

Bainitic Ferrite+Bainite+Tempered Martensite:

A crystal grain in which a white point (or white line composed of a linear array of continuously connected white point) was observed in the image analysis of the SEM photograph.

MA (Martensite/Austenite):

A crystal grain in which no white point (or no white line) was observed in the image analysis of the SEM photograph.

TABLE I

| Steel type No. | C | Si | Mn | P | S | sol-Al | Cr | Mo | Nb | sol-Ti | B | N | Si + Cr | Si + Cr + 0.8Al | Ms point | Ac3* | |
|---|---|---|---|---|---|---|---|---|---|---|---|---|---|---|---|---|---|
| | Chemical composition in wt. % | | | | | | | | | | | | | | | | |
| A | 0.192 | 0.82 | 2.55 | 0.008 | 0.0022 | 0.70 | 0.01 | | | | | 0.0040 | 0.83 | 1.39 | 386 | 902 | inventive steel |
| B | 0.187 | 0.83 | 2.56 | 0.007 | 0.0020 | 0.70 | 0.01 | | 0.030 | | | 0.0029 | 0.84 | 1.40 | 388 | 904 | inventive steel |
| C | 0.196 | 0.82 | 2.58 | 0.008 | 0.0020 | 0.69 | 0.01 | 0.10 | | | | 0.0033 | 0.83 | 1.38 | 381 | 904 | inventive steel |
| D | 0.192 | 0.82 | 2.58 | 0.008 | 0.0023 | 0.69 | 0.01 | 0.10 | 0.030 | | | 0.0032 | 0.83 | 1.38 | 383 | 903 | inventive steel |
| E | 0.205 | 0.78 | 2.57 | 0.008 | 0.0022 | 0.70 | 0.31 | | | 0.050 | | 0.0033 | 1.09 | 1.65 | 374 | 903 | inventive steel |
| F | 0.175 | 0.81 | 2.28 | 0.008 | 0.0024 | 0.290 | | | | | | 0.0045 | 0.81 | 1.04 | 403 | 870 | inventive steel |
| G | 0.172 | 0.79 | 2.27 | 0.009 | 0.0026 | 0.588 | | | | | | 0.0043 | 0.79 | 1.26 | 405 | 903 | inventive steel |
| H | 0.171 | 0.79 | 2.25 | 0.008 | 0.0026 | 0.291 | | | | | 0.0005 | 0.0045 | 0.79 | 1.02 | 406 | 870 | inventive steel |
| I | 0.177 | 0.79 | 2.24 | 0.008 | 0.0027 | 0.590 | | | | | 0.0006 | 0.0048 | 0.79 | 1.26 | 403 | 902 | inventive steel |
| J | 0.195 | 0.56 | 2.26 | 0.0065 | 0.0025 | 0.85 | 0.038 | 0.005 | 0.002 | 0.005 | 0.0003 | 0.0025 | 0.598 | 1.28 | 393 | 951 | comparative steel |
| K | 0.198 | 0.62 | 1.74 | 0.008 | 0.0024 | 0.6 | 0.013 | 0.004 | 0.002 | 0.005 | 0.0004 | 0.0028 | 0.633 | 1.11 | 409 | 884 | comparative steel |
| L | 0.168 | 0.81 | 2.49 | 0.007 | 0.0025 | 0.57 | 0.01 | 0.10 | 0.002 | 0.006 | 0.0003 | 0.0042 | 0.82 | 1.28 | 397 | 910 | inventive steel |
| M | 0.130 | 0.4 | 2.41 | 0.013 | 0.002 | 0.045 | | | | | | 0.004 | 0.4 | 0.44 | 420 | 830 | comparative steel |

Ms = 561-474C%—33Mn—17Cr—21Mo

Ac3: Measured by dilatometer

TABLE II

| Example No. | Steel type No. | Annealing temp. Tan ° C. | Annealing time, tan s | Cooling rate. CR1 ° C./s | Cooling rate. CR2 ° C./s | Stop temp. of rapid cooling $T_{RC}$ ° C. | Over-ageing temp. $T_{OA}$ ° C. | Over-ageing time $t_{OA}$ s | Thick-ness mm | Rp0.2 MPa | Rm MPa | A80 % | λ % |
|---|---|---|---|---|---|---|---|---|---|---|---|---|---|
| | | CA Parameters, mechanical properties and microstructure | | | | | | | | | | | |
| 1 | A | 910 | 180 | 90 | 41 | 340 | 420 | 540 | 1.44 | 1017 | 1140 | 13.7 | 54 |
| 2 | A | 930 | 180 | 90 | 42 | 340 | 420 | 540 | 1.43 | 1017 | 1140 | 13.7 | 54 |
| 3 | A | 910 | 180 | 90 | 41 | 340 | 460 | 540 | 1.43 | 906 | 1119 | 14.2 | 47 |
| 4 | A | 910 | 180 | 90 | 41 | 340 | 440 | 540 | 1.42 | 981 | 1131 | 15.3 | 46 |
| 5 | D | 930 | 180 | 90 | 40 | 370 | 380 | 540 | 1.47 | 876 | 1091 | 14.4 | 52 |
| 6 | E | 930 | 180 | 91 | 39 | 380 | 380 | 540 | 1.45 | 870 | 1114 | 13.8 | 50 |
| 7 | F | 910 | 180 | 90 | 39 | 360 | 400 | 540 | 1.42 | 1041 | 1133 | 11.8 | 60 |
| 8 | G | 910 | 180 | 90 | 39 | 370 | 400 | 180 | 1.43 | 912 | 1071 | 13.8 | 49 |
| 9 | H | 910 | 180 | 90 | 41 | 340 | 400 | 180 | 1.42 | 988 | 1149 | 11.5 | 57 |
| 10 | H | 910 | 180 | 90 | 39 | 360 | 400 | 540 | 1.42 | 977 | 1147 | 12.2 | 48 |
| 11 | I | 910 | 180 | 90 | 39 | 360 | 400 | 540 | 1.42 | 974 | 1150 | 12.8 | 53 |
| 12 | L | 930 | 180 | 90 | 40 | 380 | 400 | 540 | 1.43 | 873 | 1121 | 12.4 | 46 |
| 13 | A | 930 | 180 | 90 | 36 | 420 | 420 | 540 | 1.43 | 728 | 982 | 19.1 | 34 |
| 14 | B | 930 | 180 | 90 | 32 | 480 | 380 | 540 | 1.44 | 699 | 911 | 21.4 | 40 |
| 15 | D | 930 | 180 | 90 | 32 | 480 | 380 | 540 | 1.45 | 753 | 956 | 21 | 38 |
| 16 | D | 910 | 180 | 90 | 51 | 200 | 200 | 180 | 1.46 | 1036 | 1479 | 5.8 | 23 |
| 17 | F | 910 | 180 | 90 | 42 | 280 | 320 | 180 | 1.41 | 968 | 1312 | 8.2 | 62 |
| 18 | J | 930 | 180 | 90 | 39 | 360 | 400 | 540 | 1.42 | 731 | 904 | 19.8 | 35 |
| 19 | K | 910 | 180 | 90 | 40 | 360 | 400 | 540 | 1.43 | 698 | 859 | 23.2 | 25 |
| 20 | L | 850 | 180 | 90 | 40 | 340 | 380 | 540 | 1.45 | 691 | 958 | 23.6 | 30 |
| 21 | M | 850 | 180 | 90 | 36 | 350 | 300 | 540 | 1.41 | 769 | 1153 | 9.4 | 29 |
| 22 | M | 880 | 180 | 90 | 38 | 350 | 420 | 540 | 1.41 | 701 | 1045 | 10 | 49 |

| Example No. | Rm *A80 MPa % | Rm *λ MPa % | Retained Austenite vol % | Polygonal Ferrite vol % | Bainitic Ferrite + Bainite + Tempered Martensite vol % | Martensite Austenite constituent vol % | Martensite Austenite constituent size um | |
|---|---|---|---|---|---|---|---|---|
| 1 | 15559 | 61153 | 7.5 | 0 | 96 | 4.5 | 2.6 | inventive steel |
| 2 | 15559 | 61153 | 7 | 0 | 95 | 4.7 | 1.9 | inventive steel |
| 3 | 15888 | 52253 | 7.9 | 0 | 92 | 8.0 | 4.7 | inventive steel |
| 4 | 17249 | 52031 | 8.6 | 0 | 91 | 9.0 | 4.0 | inventive steel |
| 5 | 15716 | 56753 | 6.9 | 0 | 89 | 11.0 | 2.7 | inventive steel |
| 6 | 15369 | 55685 | 7.1 | 0 | 90 | 10.0 | 2.8 | inventive steel |
| 7 | 13370 | 68436 | 5.1 | 0 | 94 | 6.0 | 2.1 | inventive steel |
| 8 | 14785 | 52925 | 6.7 | 0 | 95 | 5.1 | 3.6 | inventive steel |
| 9 | 13208 | 64951 | 5.2 | 0 | 96 | 4.0 | 1.4 | inventive steel |
| 10 | 13938 | 55407 | 5.4 | 0 | 94 | 6.0 | 1.7 | inventive steel |
| 11 | 14719 | 60830 | 6.3 | 0 | 92 | 8.0 | 1.5 | inventive steel |
| 12 | 13900 | 51566 | 5.2 | 0 | 92 | 7.6 | 4.2 | inventive steel |
| 13 | 18762 | 33251 | 9.2 | 6 | 82 | 12.0 | 8.3 | inventive steel |
| 14 | 19493 | 36664 | 10.1 | 20 | 66 | 14.0 | 7.9 | comparative steel |
| 15 | 20085 | 36345 | 11.9 | 24 | 63 | 13.0 | 9.0 | comparative steel |
| 16 | 8581 | 33953 | 2 | 0 | 88 | 12.0 | 8.0 | comparative steel |

TABLE II-continued

| CA Parameters, mechanical properties and microstructure | | | | | | | | |
|---|---|---|---|---|---|---|---|---|
| 17 | 10755 | 81385 | 2 | 0 | 85 | 15.0 | 12.0 | comparative steel |
| 18 | 17899 | 31640 | 8 | 12 | 78 | 10 | 4.5 | comparative steel |
| 19 | 19929 | 21475 | 10.2 | 20 | 69 | 11 | 5.2 | comparative steel |
| 20 | 22609 | 28740 | 9 | 35 | 52 | 13 | 5.4 | comparative steel |
| 21 | 10838 | 33437 | <1 | 8 | 81 | 11.0 | 8.0 | comparative steel |
| 22 | 10450 | 51205 | <1 | 0 | 89 | 11.0 | 4.9 | comparative steel |

CR1: Ann. temp→550° C.
CR2: 550° C.→Stop.temp

INDUSTRIAL APPLICABILITY

The present invention can be widely applied to high strength steel sheets having excellent formability for vehicles such as automobiles.

The invention claimed is:

1. A high strength cold rolled steel sheet having a) a composition consisting of the following elements, in wt. %:

| | |
|---|---|
| C | 0.1-0.3 |
| Mn | 2.0-3.0 |
| Si | 0.4-1.0 |
| Cr | ≤0.6 |
| Si + 0.8 Al + Cr | 1.0-1.8 |
| Al | 0.2-0.8 |
| Nb | <0.1 |
| Mo | <0.3 |
| Ti | <0.2 |
| V | <0.1 |
| Cu | <0.5 |
| Ni | <0.5 |
| S | ≤0.01 |
| P | ≤0.02 |
| N | ≤0.02 |
| B | <0.005 |
| Ca | <0.005 |
| Mg | <0.005 |
| REM | <0.005 |

wherein Al refers to acid soluble Al, balance Fe apart from impurities, b) a multiphase microstructure comprising, in vol. %

| | |
|---|---|
| retained austenite | 5-20 |
| bainite + bainitic ferrite + tempered martensite | ≥80 |
| polygonal ferrite | ≤10 |
| martensite-austenite constituent | ≤20 |

wherein a maximum size of a martensite-austenite constituent (MA) is ≤5 μm, c) the following mechanical properties

| | |
|---|---|
| a tensile strength ($R_m$) | ≥980 MPa |
| an elongation ($A_{80}$) | ≥4 % |
| a hole expanding ratio (λ) | ≥40 % |

and fulfilling the following conditions

| | |
|---|---|
| $R_m \times A_{80}$ | ≥13 000 MPa % |
| $R_m \times \lambda$ | ≥50 000 MPa %. |

2. The high strength cold rolled steel sheet according to claim 1, wherein the composition consists of at least one of the following elements, in wt. %:

| | |
|---|---|
| C | 0.15-0.25 |
| Mn | 2.2-2.6 |
| Cr | 0.1-0.35. |

3. The high strength cold rolled steel sheet according to claim 1, wherein the composition consists of at least one of the following elements, in wt. %:

| | |
|---|---|
| Nb | 0.02-0.08 |
| Mo | 0.05-0.3 |
| Ti | 0.02-0.08 |
| V | 0.02-0.1 |
| Cu | 0.05-0.4 |
| Ni | 0.05-0.4 |
| B | 0.0005-0.003 |
| Ca | 0.0005-0.005 |
| Mg | 0.0005-0.005 |
| REM | 0.0005-0.005. |

4. The high strength cold rolled steel sheet according to claim 1, wherein the composition consists of, in wt. %:

Ti>3.4N.

5. The high strength cold rolled steel sheet according to claim 1, wherein a maximum size of a martensite-austenite constituent (MA) is ≤3 μm.

6. The high strength cold rolled steel sheet according to claim 1, wherein the multiphase microstructure comprising, in vol. %:

| | |
|---|---|
| retained austenite | 5-16 |
| bainite + bainite ferrite + tempered martensite | ≥80 |
| polygonal ferrite | ≤10 |
| martensite-austenite constituent (MA) | ≤20%. |

7. The high strength cold rolled steel sheet according to claim 1, wherein the composition consists of:

| | |
|---|---|
| C | 0.15-0.18 |
| Mn | 2.2-2.4 |
| Si | 0.7-0.9 |

Optionally one of:

| | |
|---|---|
| Al | 0.2-0.6 |
| Nb | 0.02-0.03 |

and wherein the steel sheet fulfils the following requirements

| | |
|---|---|
| ($R_m$) | 980-1200 MPa |
| ($A_{80}$) | ≥11% |
| ($\lambda$) | ≥45% |

and at least one of

| | |
|---|---|
| $R_m \times A_{80}$ | 14 000 MPa |
| $R_m \times \lambda$ | 55 000 MPa. |

8. The high strength cold rolled steel sheet according to claim 1, wherein the composition consists of:

| | |
|---|---|
| C | 0.18-0.23 |
| Mn | 2.3-2.7 |
| Si | 0.7-0.9 |
| Cr | 0-0.4 |

optionally one of:

| | |
|---|---|
| Al | 0.6-0.8 |
| Si + 0.8 Al + Cr | 1.3-1.8 |
| Nb | 0.02-0.03 |

and wherein the steel sheet fulfils the following requirements

| | |
|---|---|
| ($R_m$) | 1050-1400 MPa |
| ($A_{80}$) | ≥10%. |

9. The high strength cold rolled steel sheet according to claim 1, wherein the ratio (Mn+Cr)/(Si+Al)≥1.6.

10. The high strength cold rolled steel sheet according to claim 1, wherein the amount of Si is on the order of the amount of Al or larger than the amount of Al.

11. The high strength cold rolled steel sheet according to claim 1, which is not provided with a hot dip galvanizing layer.

12. The high strength cold rolled steel sheet according to claim 4, wherein at least one of the following elements is in the composition, in wt. %:

| | |
|---|---|
| S | ≤0.003 |
| P | ≤0.01 |
| N | ≤0.003. |

13. The high strength cold rolled steel sheet according to claim 6, wherein the multiphase microstructure comprising, in vol. %:

retained austenite below 10% martensite-austenite constituent (MA)≤16%.

14. The high strength cold rolled steel sheet according to claim 13, wherein the multiphase microstructure comprising, in vol. %:

martensite-austenite constituent (MA) below 10%.

15. The high strength cold rolled steel sheet according to claim 8, wherein the steel sheet fulfils at least one of the following conditions

| | |
|---|---|
| $R_m \times A_{80}$ | ≥13 000 MPa % |
| $R_m \times \lambda$ | ≥52 000 MPa %. |

16. The high strength cold rolled steel sheet according to claim 10, wherein Si>1.1 Al.

17. The high strength cold rolled steel sheet according to claim 16, wherein Si>1.3 Al.

18. The high strength cold rolled steel sheet according to claim 17, wherein Si>2 Al.

19. The high strength cold rolled steel sheet according to claim 7, wherein:

($\lambda$) ≥50%.

* * * * *